US011239548B2

(12) United States Patent
Merulla

(10) Patent No.: US 11,239,548 B2
(45) Date of Patent: Feb. 1, 2022

(54) COSECANT SQUARED ANTENNA RADIATION PATTERN

(71) Applicant: The Government of the United States, as represented by the Secretary of the Army, Washington, DC (US)

(72) Inventor: Emanuel Merulla, Bel Air, MD (US)

(73) Assignee: The Government of the United States, as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 16/907,392

(22) Filed: Jun. 22, 2020

(65) Prior Publication Data

US 2020/0321692 A1 Oct. 8, 2020

Related U.S. Application Data

(62) Division of application No. 15/468,146, filed on Mar. 24, 2017, now Pat. No. 1,077,573.

(51) Int. Cl.

| | |
|---|---|
| ***H01Q 1/24*** | (2006.01) |
| ***H01Q 9/27*** | (2006.01) |
| ***H01Q 1/38*** | (2006.01) |
| ***H01Q 5/335*** | (2015.01) |
| ***H01Q 21/20*** | (2006.01) |

(52) U.S. Cl.
CPC ..... *H01Q 1/38* (2013.01); *H01Q 5/335* (2015.01); *H01Q 9/27* (2013.01); *H01Q 21/205* (2013.01)

(58) Field of Classification Search
CPC ..... H01Q 1/38; H01Q 5/335; H01Q 9/27; H01Q 21/205
See application file for complete search history.

(56) References Cited

U.S. PATENT DOCUMENTS

| | | | | |
|---|---|---|---|---|
| 4,668,954 A * | 5/1987 | Tomasi | G01C 21/165 | 342/387 |
| 5,557,282 A * | 9/1996 | Mertens | G01S 7/2813 | 342/123 |
| 2003/0052831 A1 * | 3/2003 | Knop | H01Q 13/0266 | 343/786 |

* cited by examiner

*Primary Examiner* — Hoang V Nguyen
(74) *Attorney, Agent, or Firm* — Ronald Krosky

(57) ABSTRACT

Various embodiments are described that relate to an antenna. In one embodiment, the antenna can be a low profile, multi-band (e.g., dual band), emulated GPS constellation antenna. In one embodiment, the antenna can form a cube with two open sides and four circuit board sides. The four circuit boards can include a first hardware portion that allows functioning in a higher frequency band and a second hardware portion that allows functioning in a lower frequency band.

20 Claims, 10 Drawing Sheets

400

500

COSECANT SQUARED ANTENNA RADIATION PATTERN

CROSS-REFERENCE

This application is a divisional patent application of, and claims priority to, U.S. patent application Ser. No. 15/468,146 filed on Mar. 24, 2017. U.S. patent application Ser. No. 15/468,146 is hereby incorporated by reference.

GOVERNMENT INTEREST

The innovation described herein may be manufactured, used, imported, sold, and licensed by or for the Government of the United States of America without the payment of any royalty thereon or therefor.

BACKGROUND

A person can determine their current location through use of a global positioning system (GPS) device. This can be achieved through device communication with satellites. In one embodiment, the device communicates with at least three satellites to determine the location. However, if the device cannot access the satellites, then location determination cannot be achieved through this manner.

SUMMARY

In one embodiment, system, that is at least partially hardware, can comprise a reception component configured to receive an energy to excite an antenna. The system can also comprise a radiation component configured to cause the antenna to radiate a signal with a cosecant-squared antenna radiation pattern in response to the antenna being excited by the energy.

In one embodiment, an antenna panel can comprise a spiral configured to resonate a signal and a spiral trap circuit, physically coupled to the spiral, configured to cause the spiral to resonate the signal at a higher frequency band when open and configured to cause the spiral to resonate the signal at a lower frequency band when closed. The antenna panel can be configured to, at least partially, have the signal resonate with a cosecant-squared antenna radiation pattern.

In one embodiment, an emulated global positioning system constellation antenna, can comprise a first hardware side that radiates a signal at about zero degrees, a second hardware side that radiates the signal at about ninety degrees, a third hardware side that radiates the signal at about one hundred eighty degrees, and a fourth hardware side that radiates the signal at about two hundred seventy degrees. The four hardware sides can be arranged to form a six-sided cube with the two remaining sides being open and parallel. Also, the four hardware sides can individually comprise a square spiral configured to cause the signal to resonate and a square spiral trap circuit, physically coupled to the square spiral, configured to cause the signal to resonate at a higher frequency band when open and to resonate at a lower frequency band when closed.

BRIEF DESCRIPTION OF THE DRAWINGS

Incorporated herein are drawings that constitute a part of the specification and illustrate embodiments of the detailed description. The detailed description will now be described further with reference to the accompanying drawings as follows.

DETAILED DESCRIPTION

Figure 1:
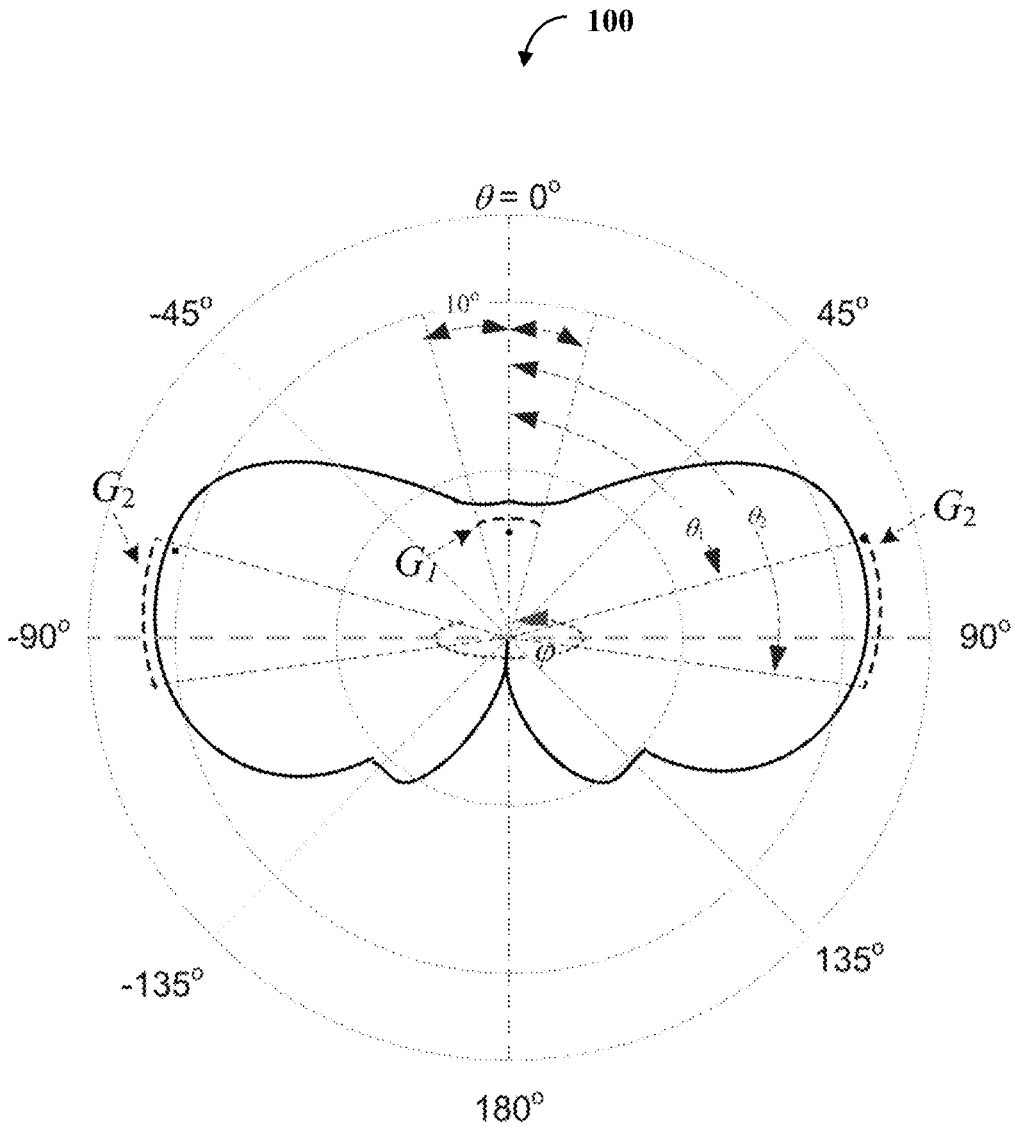
FIG. 1 illustrates one embodiment of plot demonstrating a cosecant squared pattern.

A low profile, dual band, emulated GPS constellation antenna design can be employed. The antenna can be a cube with four square spirals printed on a circuit board. The antenna can be fed with a 4:1 transmission line splitter with a quadrature output for right hand circular polarization. The antenna can have a cosecant-squared antenna radiation pattern.

The following includes definitions of selected terms employed herein. The definitions include various examples. The examples are not intended to be limiting.

"One embodiment", "an embodiment", "one example", "an example", and so on, indicate that the embodiment(s) or example(s) can include a particular feature, structure, characteristic, property, or element, but that not every embodiment or example necessarily includes that particular feature, structure, characteristic, property, or element. Furthermore, repeated use of the phrase "in one embodiment" may or may not refer to the same embodiment.

"Computer-readable medium", as used herein, refers to a medium that stores signals, instructions and/or data. Examples of a computer-readable medium include, but are not limited to, non-volatile media and volatile media. Non-volatile media may include, for example, optical disks, magnetic disks, and so on. Volatile media may include, for example, semiconductor memories, dynamic memory, and so on. Common forms of a computer-readable medium may include, but are not limited to, a floppy disk, a flexible disk, a hard disk, a magnetic tape, other magnetic medium, other optical medium, a Random Access Memory (RAM), a Read-Only Memory (ROM), a memory chip or card, a memory stick, and other media from which a computer, a processor or other electronic device can read. In one embodiment, the computer-readable medium is a non-transitory computer-readable medium.

"Component", as used herein, includes but is not limited to hardware, firmware, software stored on a computer-readable medium or in execution on a machine, and/or combinations of each to perform a function(s) or an action(s), and/or to cause a function or action from another component, method, and/or system. Component may include a software controlled microprocessor, a discrete component, an analog circuit, a digital circuit, a programmed logic device, a memory device containing instructions, and so on. Where multiple components are described, it may be possible to incorporate the multiple components into one physical component or conversely, where a single component is described, it may be possible to distribute that single component between multiple components.

"Software", as used herein, includes but is not limited to, one or more executable instructions stored on a computer-readable medium that cause a computer, processor, or other electronic device to perform functions, actions and/or behave in a desired manner. The instructions may be embodied in various forms including routines, algorithms, modules, methods, threads, and/or programs, including separate applications or code from dynamically linked libraries.

FIG. 1 illustrates one embodiment of plot 100 demonstrating a cosecant squared pattern. An antenna with this type of pattern can be used to set up emulated GPS constellations. These types of antennas can be used to evaluate the performance of GPS antennas in different environments.

An emulated GPS constellation antenna can be mounted on an airborne structure or a large tower to simulate a satellite in the sky. The emulated GPS constellation antenna can form the cosecant squared pattern. This pattern can allow GPS technologies to receive a signal at relatively constant signal levels (e.g., anywhere on the ground) which prevents front end receiver saturation. This can be important when a GPS receiver is directly under a GPS constellation transmitter. The pattern used by the GPS constellation transmitter can fit the following equation:

$$G(\varphi, \theta), \tag{1}$$

$$dBi = \begin{cases} G_0,\ dBic + 20\log_{10}\csc\left(\frac{\pi\cdot(90-|\theta|)}{180}\right), \text{ for } \begin{cases} 0^\circ \le |\theta| \le \theta_1 \\ 0^\circ \le \varphi \le 360^\circ \end{cases} \\ G_2,\ dBic,\ 70^\circ \le |\theta| \le 100^\circ \end{cases}$$

where G0=−8 dBic, and G2=0 dBic. While ideally the pattern would fit the above equation, in practice the pattern would likely not fit this equation perfectly as rarely is a mathematical model perfectly achieved in practice. An example realistic pattern is shown in FIG. 1, which would give a received signal strength that is approximately constant.

In one example environment, four friends can individually drive their all-terrain vehicles (ATVs) together in a wooded and mountainous area. The ATVs can be equipped with GPS capabilities that achieve GPS location determination through triangulation with satellites. The four friends can explore different parts of the area on their own. While out exploring, one of the friends can lose contact with the GPS satellites. However, it can be beneficial for the friend that has lost GPS contact to be able to know his or her position. For example, due to heavy treetop foliage the disconnected friend can have limited skyward communication capabilities, but can have relatively good lateral communication capabilities to communicate with his or her friends. Therefore, the other three friends that do have GPS satellite connectivity can communicate their positions to their friend that does not have GPS communications. This can be achieved through use of an antenna individually for the three friends.

Figure 2A:
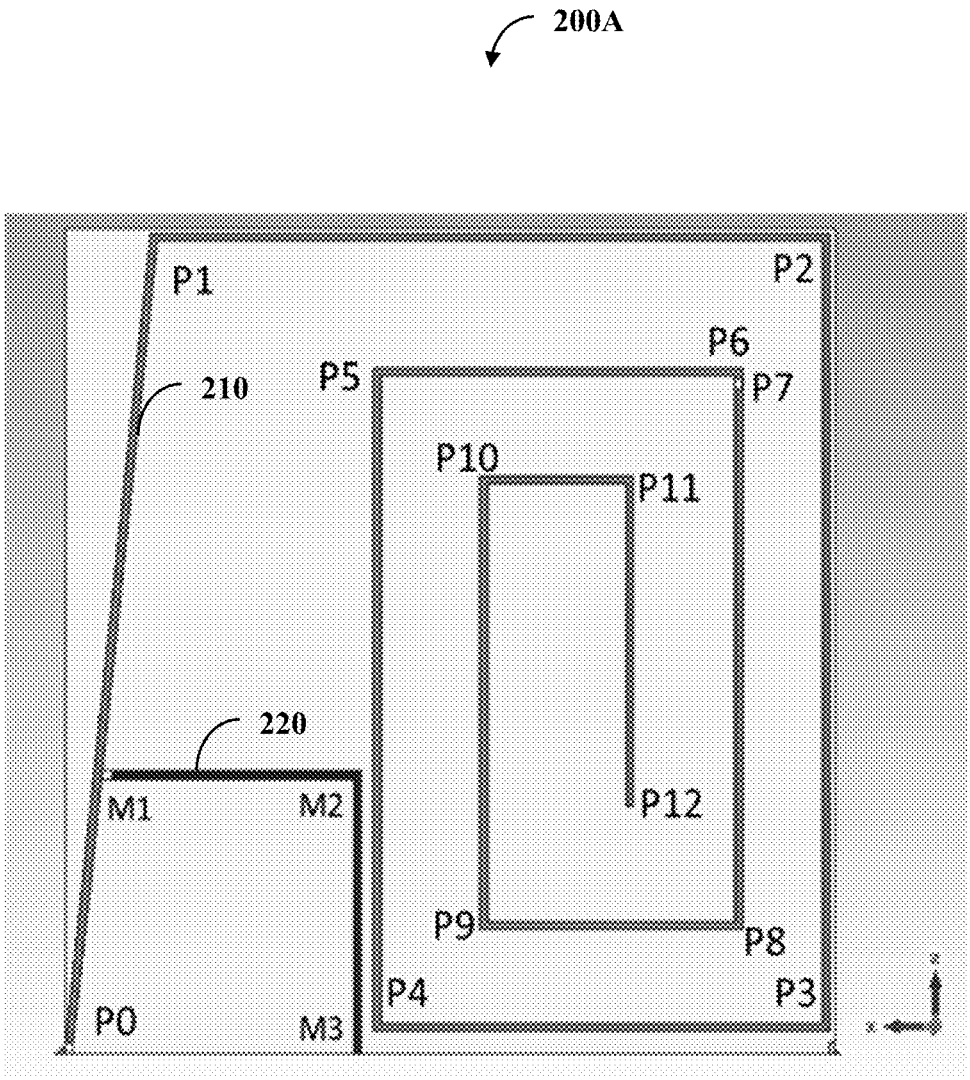
FIG. 2A illustrates one embodiment of the antenna panel.
Figure 2B:
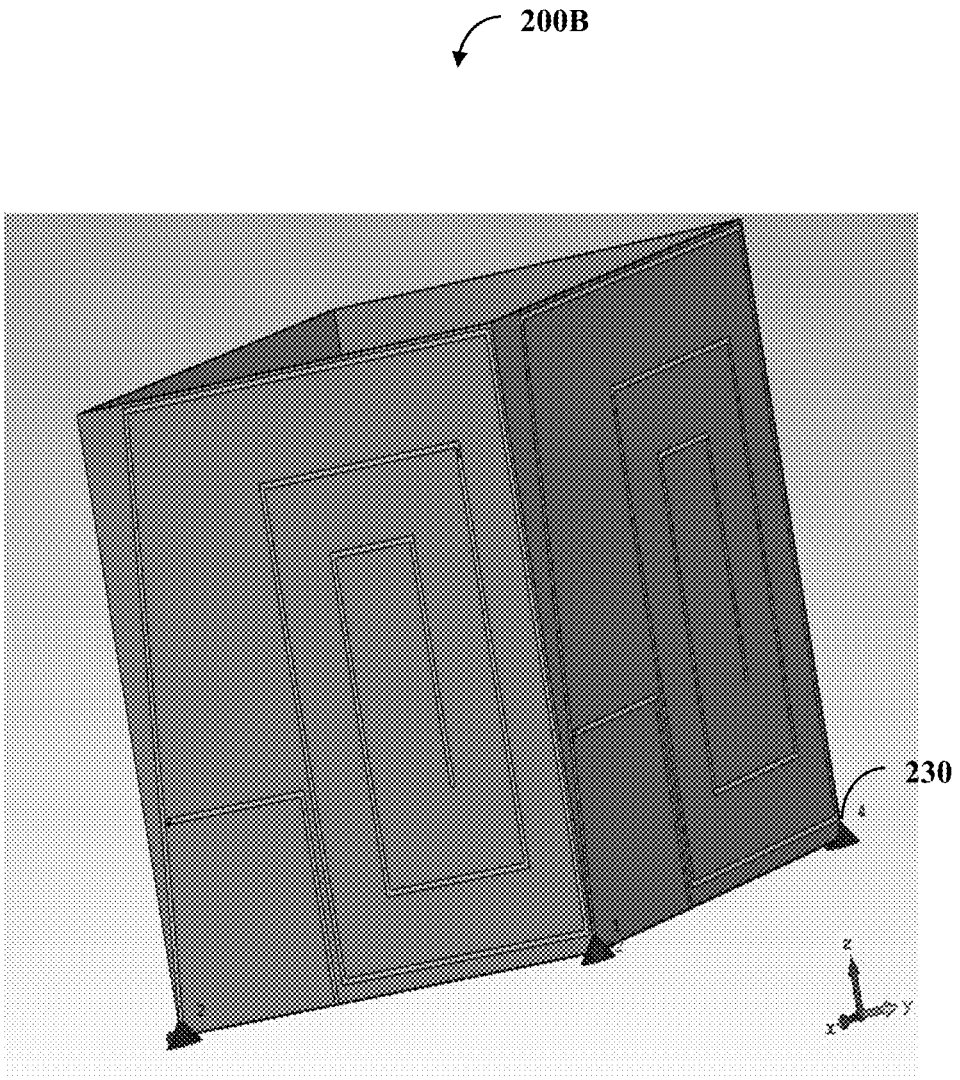
FIG. 2B illustrates one embodiment of an antenna.

FIG. 2A illustrates one embodiment of the antenna panel 200A while FIG. 2B illustrates one embodiment of an antenna 200B. In one example, the antenna 200B can operate in more than one band, such as dual band at 1575.5 Megahertz (MHz) and 1227.6 MHz. The antenna 200B can comprise four of the antenna panels 200A (functioning as hardware sides facing out at 0, 90, 180, and 270 degrees respectively) arranged to form a six-sided cube with the two remaining sides open and parallel (e.g., completely open, open except for structural support, or substantially parallel). The cube can be powered by way of a 4:1 splitter transmission that powers the corners 230. The cube can be placed on a ground plane. The ground plane can be 75 millimeters (mm)×75 mm.

The panel 200A can have a spiral configured to cause the signal to resonate. In one embodiment, the panel can be 73.3 mm×73.3 mm with a strip width of 0.7 mm. The spiral can be a square spiral with 13 connection points P0-P12 that is a strip with a width of 0.7 mm. A design component can function to determine the location of the connection points and in turn the length of the spiral. In one embodiment, the design component can determine the location of the connection points P0-P12 to optimize resonant operation at the lower frequency band while achieving the cosecant square pattern.

To achieve resonant operation at the higher frequency band, a trap circuit can be employed (e.g., at P7). The trap can be open at its resonant frequency and therefore function at about infinite impedance. At the lower frequency, the trap circuit acts similar to a short with a low reactive impedance. This allows the antenna to have the correct pattern at both the higher and lower bands. In practice this gives the spiral two lengths a first length (P0-P6) when the trap is open and a second length (P0-P12) when the trap is closed. With this, the trap circuit can cause the signal to resonate at a higher frequency band when open and to resonate at a lower frequency band when closed.

In one embodiment, the trap circuit can comprise an inductor (with inductance L) parallel with a capacitor (with capacitance C). In one example, the trap circuit values can be L=6.8 nanohenry and C=1.5 picofarad. Values for the inductor and/or capacitor of the trap circuit can be determined by the design component through use of the equation below:

$$f = \frac{1}{2\pi\sqrt{LC}} = \frac{1}{2\pi\sqrt{6.8e-9*1.51e-12}}\,1575.5\text{ MHz} \tag{2}$$

In one embodiment, the panel can be improved such that return loss is lowered, where return loss is a ratio of the signal radiated inward against the signal radiated outward. Alternatively, it is more desirable for the signal to be radiated away from the antenna 200B as opposed to back into the antenna 200B. This lowered return loss can be accomplished in through other alternative methods.

In one embodiment, the return loss can be improved through use of a matching leg 220. The points of the leg M1-M3 can be determined by the design component and optimized for lower frequency impedance. The matching leg can match the antenna at the lower frequency band (e.g., single frequency or frequency range) or multiple matching legs can be used (e.g., one for the higher frequency band (L1) and one for the lower frequency band (L2)). The matching leg can also have a matching leg trap circuit. When using one leg, it can be difficult for the matching leg trap circuit with the matching leg to maintain the desired cosecant squared pattern. Therefore, a matching network can be used to achieve a desirable match at the higher frequency band. The matching network can be an inductor in series with the feed and capacitor to ground with the values of L=9.6 nh and C=0.83 pf that can be determined by the design component.

In one embodiment, a second matching leg can be employed to cause the return loss of the antenna to be lower in the lower frequency band. In that, two legs are used—one to improve return loss in the higher frequency band and one to improve loss in the lower frequency band.

In one embodiment, the design component can select placement for the points and in turn the spiral and/or leg portions that link those points. For the frequencies 1575.5 MHz and 1227.6 MHz, the dimensions can be:

| | X | Z |
|---|---|---|
| P0 | 36.3 | 1.0 |
| P1 | 28.3 | 72.5 |
| P2 | −35.8 | 72.5 |
| P3 | −35.8 | 2.4 |
| P4 | 7.0 | 2.4 |
| P5 | 7.0 | 60.5 |
| P6 | −27.5 | 60.5 |
| P7 | −27.5 | 59.5 |
| P8 | −27.5 | 11.4 |
| P9 | −3.2 | 11.4 |
| P10 | −3.2 | 51 |
| P11 | −17.1 | 51 |
| P12 | −17.1 | 22 |
| M1 | 32.2 | 24.7 |
| M2 | 8.8 | 24.7 |
| M3 | 8.8 | 0 |

with the 0,0 point in the lower left corner of the panel 200A.

Figure 3:
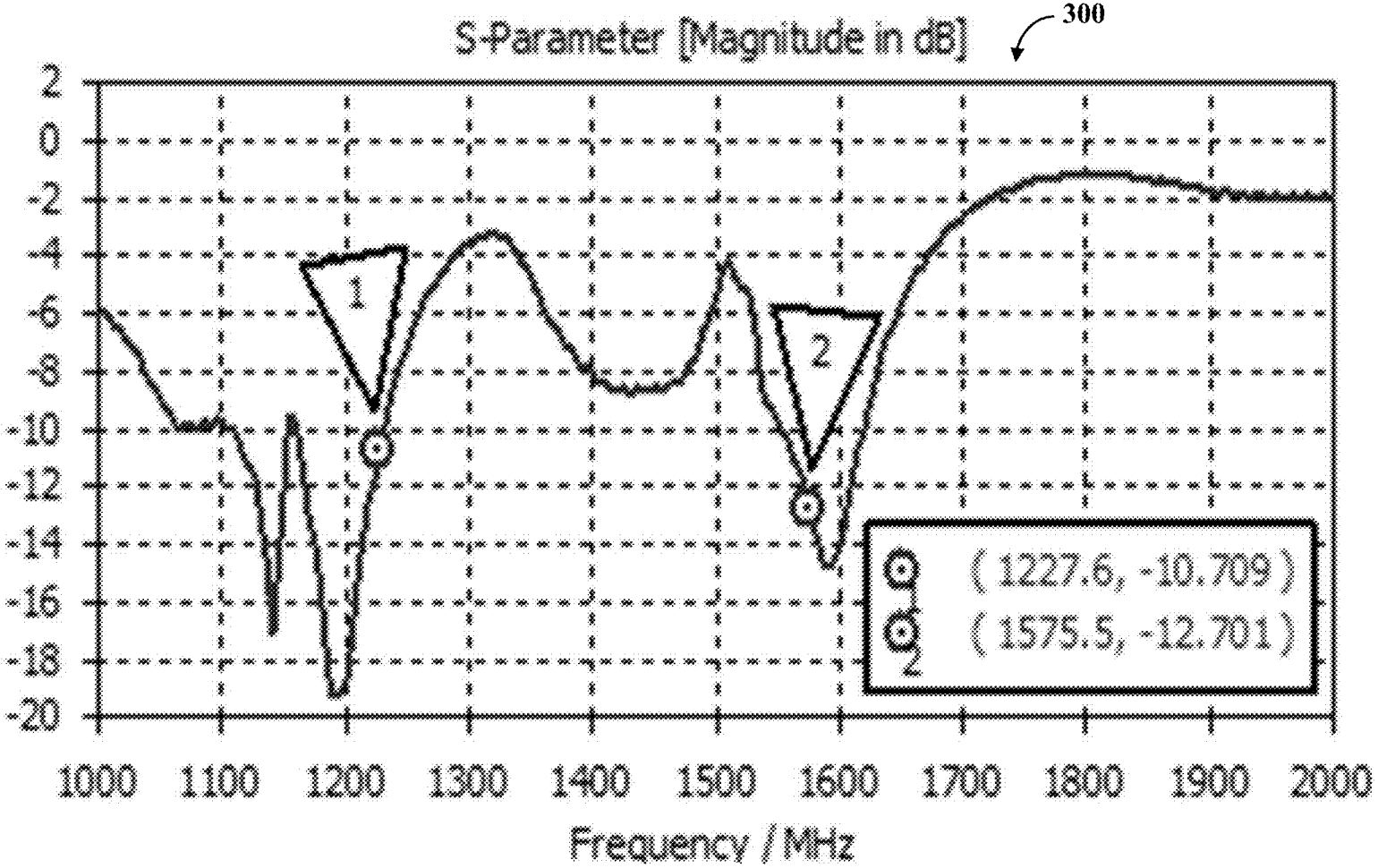
FIG. 3 illustrates one embodiment of a plot that illustrates return loss.

FIG. 3 illustrates one embodiment of a plot 300 that illustrates return loss. Point 1 is shown for the lower frequency band while point 2 is shown for the higher frequency band. The return loss is greater than 10 decibels (dB) at the higher frequency band (return loss of 10.709 dB) and at the lower frequency band (return loss of 12.701 dB).

Figure 4:
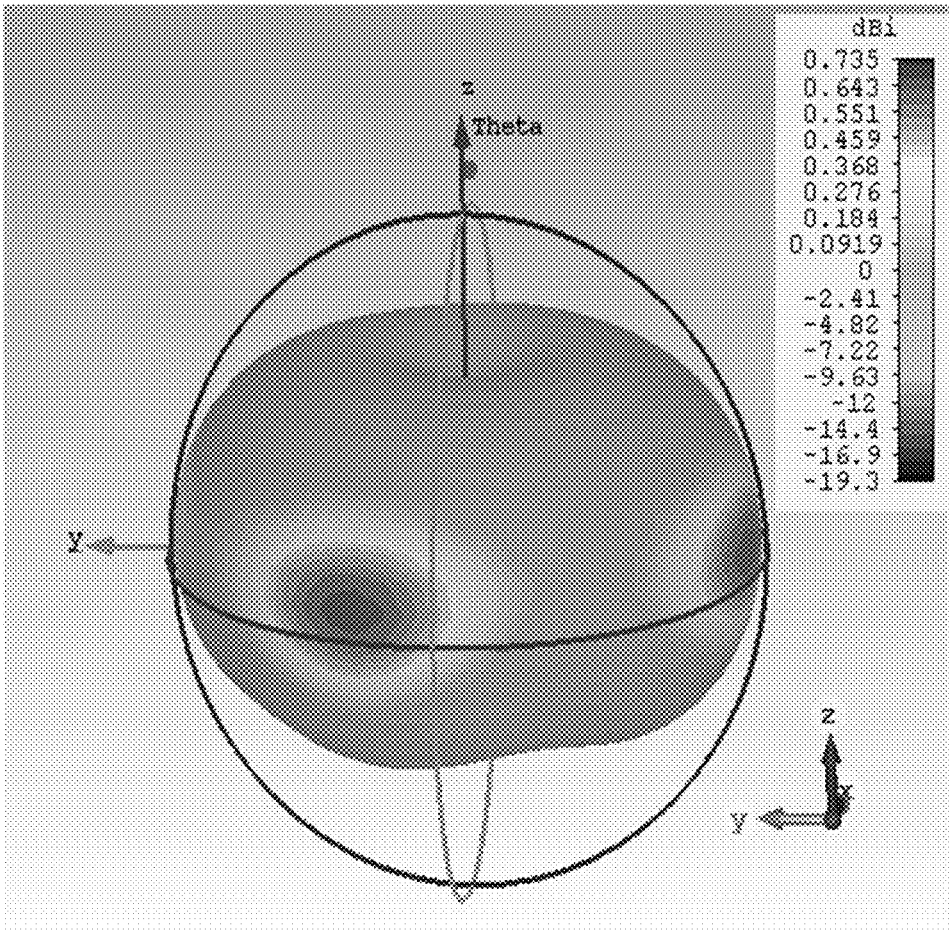
FIG. 4 illustrates one embodiment of a plot with a three dimensional pattern.

FIG. 4 illustrates one embodiment of a plot 400 with a three dimensional pattern. The plot 400 is of the lower frequency band. The plot 400 is illustrated according to decibels isotropic (dBi).

Figure 5:
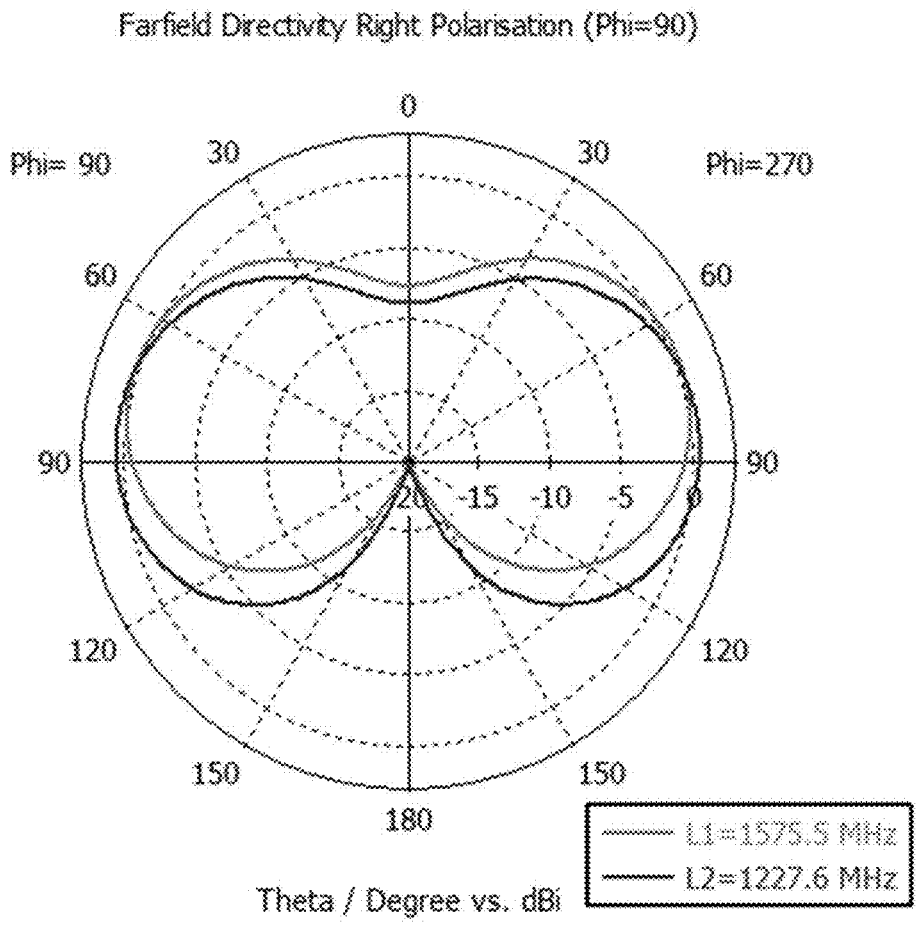
FIG. 5 illustrates one embodiment of a plot with the two bands.

FIG. 5 illustrates one embodiment of a plot 500 with the two bands. The above line at 0 degrees is the 1575.5 MHz frequency band while the below band at 0 degrees is the 1227.6 MHz frequency band.

Figure 6:
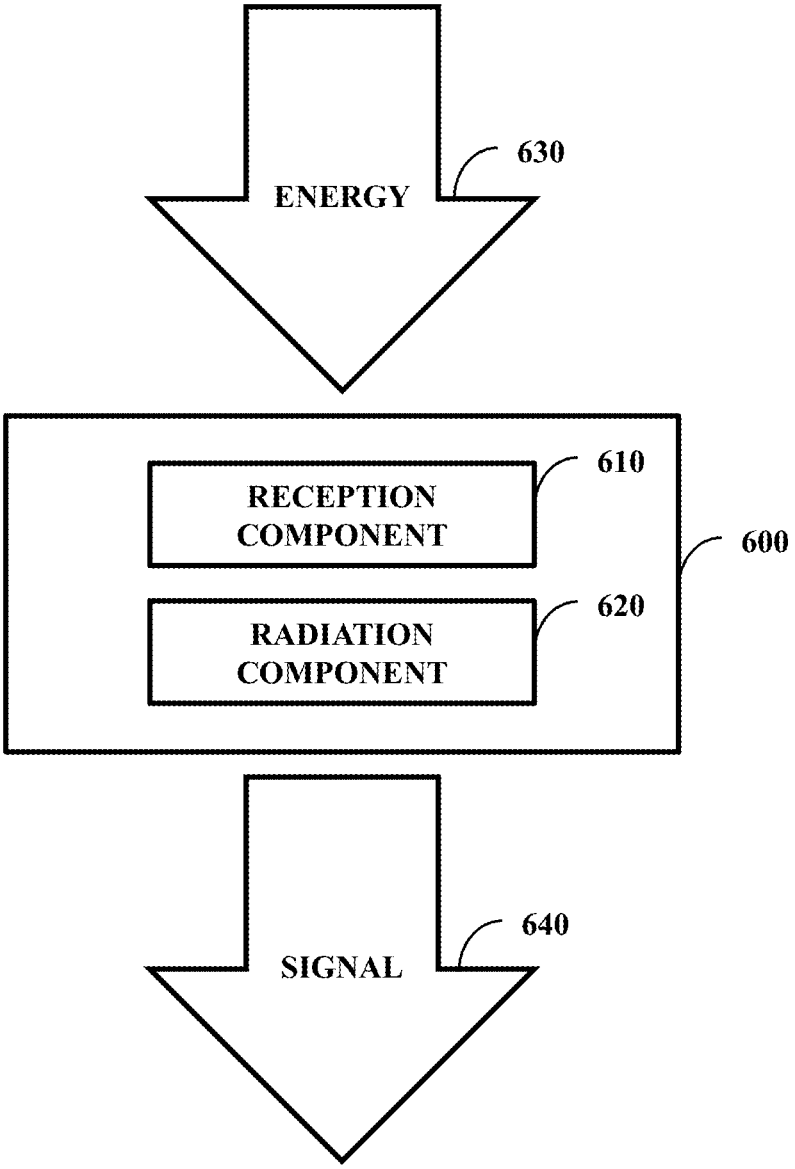
FIG. 6 illustrates one embodiment of a system comprising a reception component and a radiation component.

FIG. 6 illustrates one embodiment of a system 600 comprising a reception component 610 and a radiation component 620. The reception component 610 can be configured to receive an energy 630 to excite an antenna, such as when the system 600 is part of the antenna. In one embodiment, the reception component can be a receiver with the 4:1 transmission line splitter and a quadrature output. The radiation component 620 can be configured to cause the antenna to radiate a signal 640 with a cosecant-squared antenna radiation pattern in response to the antenna being excited by the energy 630.

Figure 7:
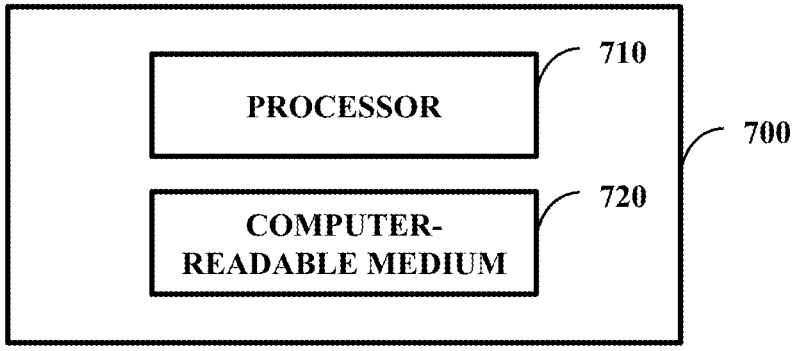
FIG. 7 illustrates one embodiment of a system comprising a processor and a computer-readable medium.

FIG. 7 illustrates one embodiment of a system 700 comprising a processor 710 (e.g., a general purpose processor or a processor specifically designed for performing a functionality disclosed herein) and a computer-readable medium 720 (e.g., non-transitory computer-readable medium). In one embodiment, the computer-readable medium 720 is communicatively coupled to the processor 710 and stores a command set executable by the processor 710 to facilitate operation of at least one component disclosed herein (e.g., the radiation component 620 of FIG. 6 is a set of instructions that determines when to open or close switches, as opposed to the trap circuits, for when to function at the higher or lower frequency band). In one embodiment, at least one component disclosed herein can be implemented, at least in part, by way of non-software, such as implemented as hardware by way of the system 700 (e.g., the design component disclosed above). In one embodiment, the computer-readable medium 720 is configured to store processor-executable instructions that when executed by the processor 710, cause the processor 710 to perform a method disclosed herein (e.g., the methods 800-900 addressed below).

Figure 8:
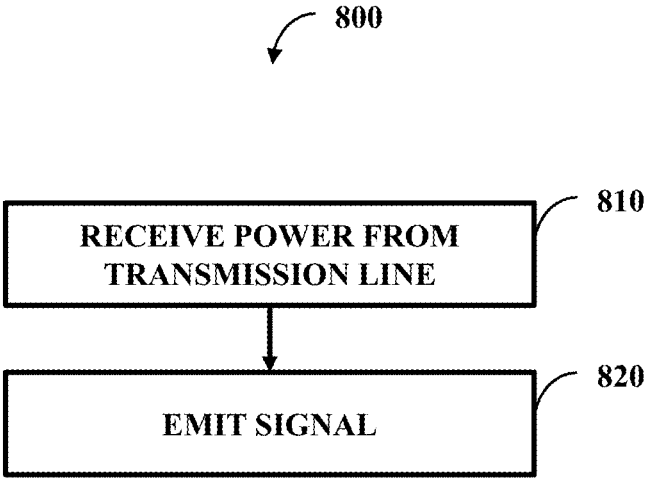
FIG. 8 illustrates one embodiment of a method comprising two actions.

FIG. 8 illustrates one embodiment of a method 800 comprising two actions 810-820. The method 800 can be performed by panel 200A of FIG. 2A and/or the antenna 200B of FIG. 2B. At 810, the antenna 200B of FIG. 2B can receive power from the transmission line. In response to receiving this power, the antenna 200B of FIG. 2 can be excited to emit the signal at 820.

Figure 9:
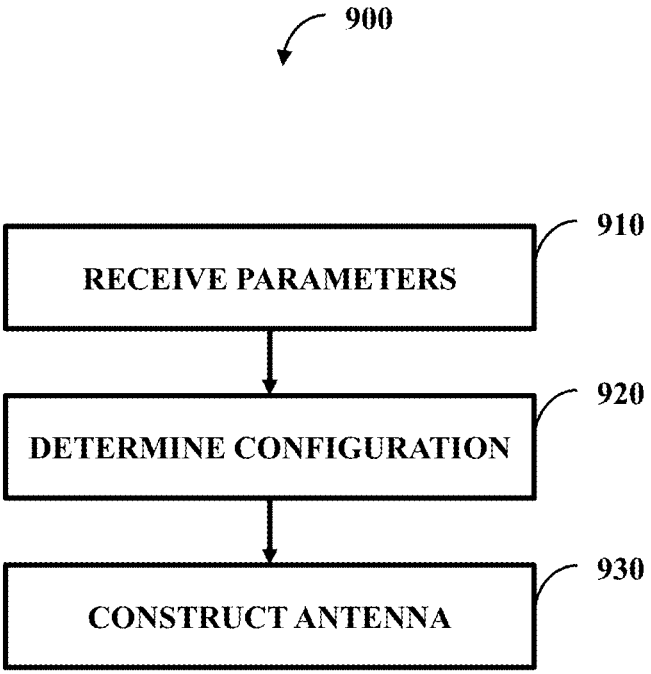
FIG. 9 illustrates one embodiment of a method comprising three actions.

FIG. 9 illustrates one embodiment of a method 900 comprising three actions 910-930. The method 900 can be employed by the system 700, such as when part of a manufacturing apparatus to manufacture the antenna 200B of FIG. 2B. At 910, parameters can be received, such as the frequency bands for the antenna. In one example, if the antenna is a tri-band antenna, then a list with the three frequency bands can be received. Based on this information, a configuration for the antenna can be determined at 920. Determining the configuration can include, for example, determining the points P0-P12 and where to place the circuit trap(s) as well as determining how to arrange the matching arm(s) and/or matching circuit(s) as well as whether to use the matching arm, matching circuit, or both. With the configuration determined, the antenna 200B of FIG. 2B can be constructed at 930.

While the methods disclosed herein are shown and described as a series of blocks, it is to be appreciated by one of ordinary skill in the art that the methods are not restricted by the order of the blocks, as some blocks can take place in different orders. Similarly, a block can operate concurrently with at least one other block.

What is claimed is:

1. A system, that is at least partially hardware, comprising:

a reception component configured to receive an energy to excite an antenna; and a radiation component configured to cause the antenna to radiate a signal with a cosecant-squared antenna radiation pattern in response to the antenna being excited by the energy, the antenna comprises a spiral configured to radiate the signal and the antenna comprises a spiral trap circuit, physically coupled to the spiral, configured to cause the spiral to radiate the signal at a higher frequency band when open and configured to cause the spiral to radiate the signal at a lower frequency band when closed.

2. The system of claim 1, the antenna comprising:

a matching leg configured to cause a return loss of the antenna to be lower in the higher frequency band.

3. The system of claim 2, the antenna comprising:

a matching leg trap circuit, physically coupled to the matching leg, configured to be closed at the lower frequency band and open when at the higher frequency band; and a coupling hardware component configured to physically couple the antenna to a matching network configured to cause the return loss of the antenna to be lower in the higher frequency band when the matching leg trap circuit is open.

4. The system of claim 2, the antenna comprising:
a second matching leg configured to cause the return loss of the antenna to be lower in the lower frequency band.

5. The system of claim 1,
where the spiral trap circuit comprises an inductor parallel with a capacitor.

6. The system of claim 1,
where the signal is a global positioning system constellation.

7. The system of claim 1,
where the signal has right hand circular polarization.

8. A system, that is at least partially hardware, comprising:
a reception component configured to receive an energy to excite an antenna; and
a radiation component configured to cause the antenna to radiate a signal with a cosecant-squared antenna radiation pattern in response to the antenna being excited by the energy,
the antenna comprising a spiral configured to radiate the signal,
the antenna comprising a matching leg configured to cause a return loss of the antenna to be lower in the higher frequency band, and
the antenna comprising a spiral trap circuit, physically coupled to the spiral, configured to cause the spiral to radiate the signal at a higher frequency band when open and configured to cause the spiral to radiate the signal at a lower frequency band when closed, with the spiral trap circuit comprising an inductor parallel with a capacitor.

9. The system of claim 8, the antenna comprising:
a matching leg configured to cause a return loss of the antenna to be lower in the higher frequency band.

10. The system of claim 9, the antenna comprising:
a matching leg trap circuit, physically coupled to the matching leg, configured to be closed at the lower frequency band and open when at the higher frequency band; and
a coupling hardware component configured to physically couple the antenna to a matching network configured to cause the return loss of the antenna to be lower in the higher frequency band when the matching leg trap circuit is open.

11. The system of claim 9, the antenna comprising:
a second matching leg configured to cause the return loss of the antenna to be lower in the lower frequency band.

12. The system of claim 8,
where the signal is a global positioning system constellation.

13. The system of claim 8,
where the signal has right hand circular polarization.

14. The antenna comprising:
a spiral configured to radiate a signal with a cosecant-squared antenna radiation pattern; and
a spiral trap circuit, physically coupled to the spiral, configured to cause the spiral to radiate the signal at a higher frequency band when open and configured to cause the spiral to radiate the signal at a lower frequency band when closed,
where a reception component is configured to receive an energy to excite the antenna and
where a radiation component configured to cause the antenna to radiate the signal with the cosecant-squared antenna radiation pattern in response to the antenna being excited by the energy.

15. The antenna of claim 14 comprising:
a matching leg configured to cause a return loss of the antenna to be lower in the higher frequency band.

16. The antenna of claim 15 comprising:
a matching leg trap circuit, physically coupled to the matching leg, configured to be closed at the lower frequency band and open when at the higher frequency band; and
a coupling hardware component configured to physically couple the antenna to a matching network configured to cause the return loss of the antenna to be lower in the higher frequency band when the matching leg trap circuit is open.

17. The antenna of claim 15 comprising:
a second matching leg configured to cause the return loss of the antenna to be lower in the lower frequency band.

18. The antenna of claim 14 comprising:
where the spiral trap circuit comprises an inductor parallel with a capacitor.

19. The antenna of claim 14 comprising:
where the signal is a global positioning system constellation.

20. The antenna of claim 14 comprising:
where the signal has right hand circular polarization.

* * * * *